US006211896B1

(12) United States Patent
Morton

(10) Patent No.: US 6,211,896 B1
(45) Date of Patent: Apr. 3, 2001

(54) METHOD FOR PRODUCING LENTICULAR IMAGES

(75) Inventor: Roger A. Morton, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/212,651

(22) Filed: Dec. 16, 1998

(51) Int. Cl.[7] ..... B41J 2/47
(52) U.S. Cl. ..... 347/225; 353/32; 359/463
(58) Field of Search ..... 347/225, 257; 353/32; 355/33; 359/455, 463, 462, 619; 396/306, 311, 330; 395/109

(56) References Cited

U.S. PATENT DOCUMENTS

| | | | | |
|---|---|---|---|---|
| 5,276,478 | | 1/1994 | Morton | 355/22 |
| 5,473,406 | | 12/1995 | Hassall et al. | 355/22 |
| 5,492,578 | | 2/1996 | Morton | 156/64 |
| 5,724,758 | * | 3/1998 | Gulick, Jr. | 40/454 |
| 5,781,225 | | 7/1998 | Syracuse et al. | 347/258 |
| 5,867,322 | * | 2/1999 | Morton | 359/619 |
| 5,946,509 | * | 8/1999 | Morton | 396/311 |
| 5,966,506 | * | 10/1999 | Morton | 395/109 |

* cited by examiner

*Primary Examiner*—N. Le
*Assistant Examiner*—Hai C. Pham
(74) *Attorney, Agent, or Firm*—Thomas H. Close

(57) ABSTRACT

A method for producing lenticular images is suggested, which improves the image quality of the lenticular images. The images are written with a writing spot which is scanned over a recording material. The shape of the writing spot and at least one component of the recording material influence the image quality of the recorded image. The improvement of the present invention comprises to shape the writing spot or at least one of the contributing components of the recording material to obtain an overall response which is substantially trapezoidal. The summation of the overall responses is free from ripples and thereby improves the image quality.

5 Claims, 5 Drawing Sheets

METHOD FOR PRODUCING LENTICULAR IMAGES

FIELD OF THE INVENTION

The invention relates generally to the field of lenticular and barrier images, and in particular to a method for producing lenticular images, by modifying the shape and the size of a writing spot. The method is especially used to improve the image quality of the images.

BACKGROUND OF THE INVENTION

Prior art lenticular systems suffer from one or two problems. Some lenticular image manufacturing processes produce images with the individual views being indistinct from each other. Other lenticular manufacturing processes provide images which show Moiré patterns or other flickering effects especially when consecutive views have identical areas such as stationary areas in motion images. Such images may still provide views which are indistinct from each other. Thus, unfortunately, some prior art images showed both problems at the same time. In images using the present invention these problems are solved. The reason for this is that the views which are contained in lenticular images are typically formed from the interaction of as few as 3 and as many as 6 or more components. The first of these is the shape of the writing spot which writes the media.

However, even if the writing spot shape as shown in U.S. Pat. No. 5,781,225, issued Jul. 14, 1998, to Syracuse et al. entitled "Method and Apparatus for Improving Electronic Recording of Depth Images," approaches the ideal shape in practice; the ideal shape is not apparent to the viewer. Instead he sees images which suffer from the problem that views are indistinct from each other due to the degradation contributed by the other components, such as the degradation due to the limited resolution capabilities of the writing media and the limited resolution performance of the lenticular lens. Furthermore, if the lenticular image is made using a printing process or photographic film contact process, then these additional components will also further degrade the distinctiveness of views. Thus, in general, each of these components contribute to the degradation of the viewed images.

In prior art inventions the shape of the overall combined single view response was not considered when optimizing image quality. Nor were methods for customizing the overall combined single view response by modifying the response of the underlying components.

Previously in order to write lenticular images with a large number of views, using a digital or electronic writer, the size of the writing spot was modified so that the width of the writing spot met the resolution requirements imposed by the necessity of having multiple views behind each lenticule. However, except for the prior art already mentioned, attention has not been paid to spot shape or to the overall combined spot shape.

As stated, the combined overall spot shape is very important for producing high quality lenticular images. Although the size of the spot may be different, the shape of the spot in the direction across the lenticules can be defined by similar considerations to the shape of the spot in the direction along the lenticules. Thus, this specification will primarily discuss the spot shape across the lenticules, however the methodology described herein can be applied along the spot shaped lenticules.

SUMMARY OF THE INVENTION

The present invention is directed to overcoming one or more of the problems set forth above. Briefly summarized, according to one aspect of the present invention, there is a method for producing lenticular images which comprises:

using a writing spot to write a lenticular image wherein such image has at least one contributing component having an overall spot response shape which as a function of viewing angle has a peak on each side of a region of lower value, to obtain an overall visual response of the lenticular image;

scanning said writing spot relative to a recording material to produce pixels directly on said recording material.

According to another aspect of the invention there is a method for producing lenticular images which comprises the steps of:

using a writing spot, wherein said writing spot having a shape as a function of viewing angle with a peak on each side of a region of lower value, and scanning said writing spot relative to a recording material to produce pixels directly on said recording material.

In yet a further embodiment of the invention a method is suggested which comprises the steps of:

scanning a writing spot relative to a recording material to produce pixels directly on said recording material, wherein the line pitch between successive scan lines is p and said writing spot has a width less than said line pitch, and;

writing with said writing spot between said successive scan lines such that an overall response is a flat response.

Improvement in viewed image quality is achieved by compensating for the degradation of some components which contribute to the spot shape. The modification of the contributing components results in a writing spot with a shape which as a function of viewing angle, or lenticular lens response, or the media response is so that the profile of at least one component profile when subtracted from a Gaussian shaped response with the same mean value and standard deviation of the profile, has a difference where there is a positive central peak of at least 10% of the area of the Gaussian shaped response, and a negative peak on each side of the positive peak of at least 5% of the area of the Gaussian shaped response.

Alternatively, this goal is achieved by compensating for the degradation of some components by modifying other components such as the writing spot with a shape which as a function of viewing angle is so that the profile of at least one component profile has a profile which has a peak on each side of a region of lower value.

Another aspect of this invention is to not only change the effective combined overall spot shape, but to change the scan line spacing and/or lenticular spacing based on the overall combined response of the imaging system in order to achieve the best utilization of the overall available resolution characteristics of the lenticular imaging components.

Another aspect of this invention is to choose the overall characteristics of the system including scan line spacing and lenticular spacing as well as overall spot shape as a function of the content and/or characteristics of the image to be written. Examples of different content may include motion, stills, flip, depth, or other effects. Another aspect of content is the amount of motion from view to view or the size of features and objects within each view. Other characteristics include the amount of contrast or color between different views. This may vary depending on the specific view and may even vary with position across the views.

For example, in areas of high motion there will be significant color differences or contrast between consecutive views. Because in some image components spot size or edge rise distance may be a function of contrast or color differences, it is necessary to change spot size or shape in some components to compensate for these effects.

Another aspect of this invention are various means for modifying the shape of the profile (that is to say the shape of intensity profile) of the components which have been selected to modify the overall combined response. Because it is generally necessary to achieve a profile with two peaks or one which compensates for the effects of the intrinsic Gaussian shape of other components, it is necessary to have means to change both the geometric shape and intensity of the profile.

These and other aspects, objects, features, and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention improves image viewing quality of lenticular images.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
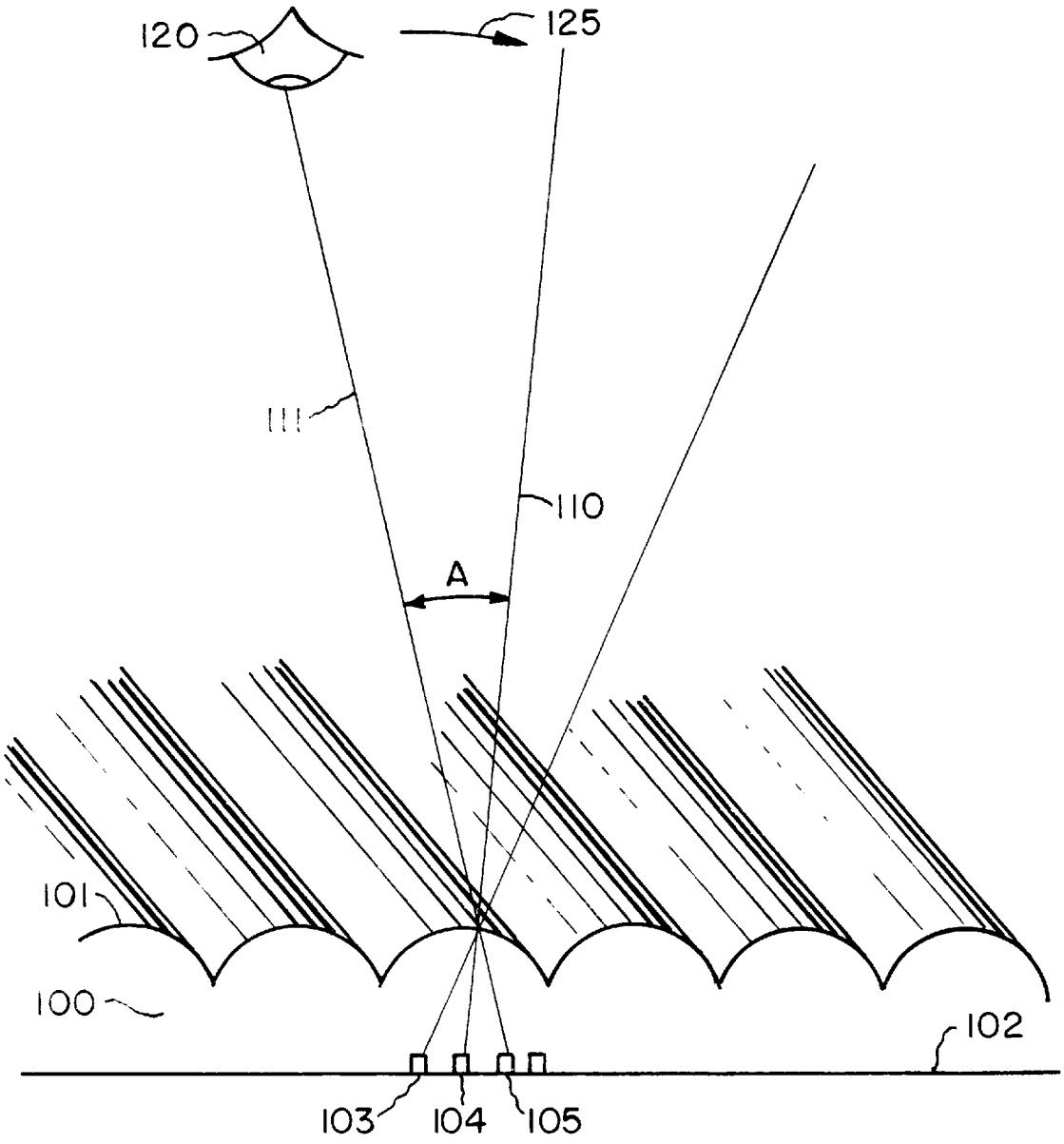
FIG. 1 is a sectioned view illustrating different view paths to a number of image frames.

FIG. 1 illustrates a basic lenticular imaging configuration wherein a lenticular lens sheet 100 is formed with a plurality of elongated lenticular lenses 101 for imaging an image pattern onto an image plane 102. Under each lenticule lens there may be between two and fifty image patterns and sometimes more to ensure that a range of views can be seen for either motion, depth, or other lenticular imaging effects. The location of these images is shown generically as 103, 104, 105, etc. Image 104 is seen from a viewing direction 110 by a viewer's eye 120 positioned along viewing direction 110 while image 105 is seen along viewing direction 111. The viewing direction 110 of image 104 and the viewing direction 111 of the image 105 define a viewing angle A. The viewing angle A represents the angular position of two consecutive images. The images on image plane 102 may be written from a variety of means including printing using conventional printing press techniques with stochastic or half-toning techniques or by exposing photographic emulsion using thermal imaging techniques, xerographic, or electrostatic ink jet, or other imaging methods. The actual writing may be performed using a direct writing method or may involve contact printing, for example, using photographic emulsion or may be printed using printing press methods. In the case of contact printing or printing press or related methods a master image may be generated using a digital or other electronic direct wiring method. Alternately, ink jet, resistive thermal, or laser thermal methods may be used.

Figure 2:
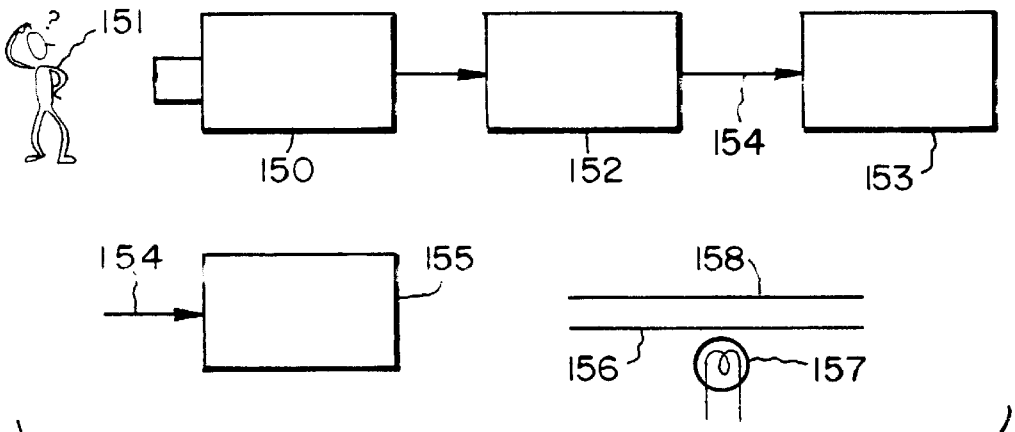
FIG. 2 is a block diagram illustrating a system for capturing images and for forming the images on an imaging sheet.

FIG. 2 is a block diagram of one method of making lenticular motion images. A movie camera 150 views a moving scene 151 and generates electronic signals which are digitally processed in a computer 152 and outputted on a line 154. Individual frames of the captured moving scene are used to make up the frames of the lenticular motion image. These frames may be exposure compensated, color processed, color selected, cropped, zoomed, aligned, sharpened, and then merged together to form the individual line structure pattern which is written by a writer 153 onto the imaging material positioned at the image plane 102. The material with the image printed may then be aligned with the lenticular lens sheet 100 or the image may be directly written on a sensitive layer which is attached to the lenticular lens sheet 100. Other printing techniques include taking the signal on line 154 to a printer 155 which produces a negative image 156 which is in turn contact printed by light exposure from a light source 157 to produce an exposed print 158 which is then processed using a processor the same or different to the processor used to process image 156. If the exposure is directly on the lenticular lens sheet 100, then the image simply needs to be cut and finished. However, if the exposure is an exposed print, then this exposed print will need to be attached to the lenticular lens sheet 100 using an appropriate alignment method. Such alignment methods are described in U.S. Pat. No. 5,473,406, issued Dec. 5, 1995, to Hassall et al., entitled "Apparatus and Methods for Assembling Depth Image Systems", and in U.S. Pat. No. 5,492,578, issued Feb. 20, 1996, to Morton, entitled "Alignment Apparatus and Associated Methods for Depth Images".

Spot Shape in the Direction at Right Angles to the Lenticules

For images where motion is desired it is often necessary to achieve a maximum distinction between frames, where a frame is defined as one single view. For example, a frame may be one view generated by all the spots associated with, viewed by the viewer across all viewing directions. This definition assumes that the viewer's eye 120 is at a viewing distance specified by the specific image. (For more information on this see U.S. Pat. No. 5,276,478, issued Jan. 4, 1994, to Morton, entitled, "Method and Apparatus for Optimizing Depth Images by Adjusting Print Spacing".)

This invention makes the overall visual response seen by the viewer as he scans from image to image as uniform as possible (so as to not introduce flicker or Moiré) for images where the frames are the same. This is achieved by first determining the effective spot shape seen by the viewer in lenticular images not using the present invention and then shaping or otherwise modifying one or more components contribution to the overall visual response so that the overall visual response is uniform. Thus the overall visual response is the combined effect of a series of contributing components. These components may include the writing spot, the negative film material, the contact printer, the final print film emulsion layer or image layer, the reflexion layer, the lenticular lens and the viewer. Other lenticular constructions or manufacturing processes will involve other components. Each of these components has an effect on the shape of the overall response.

Figure 3:
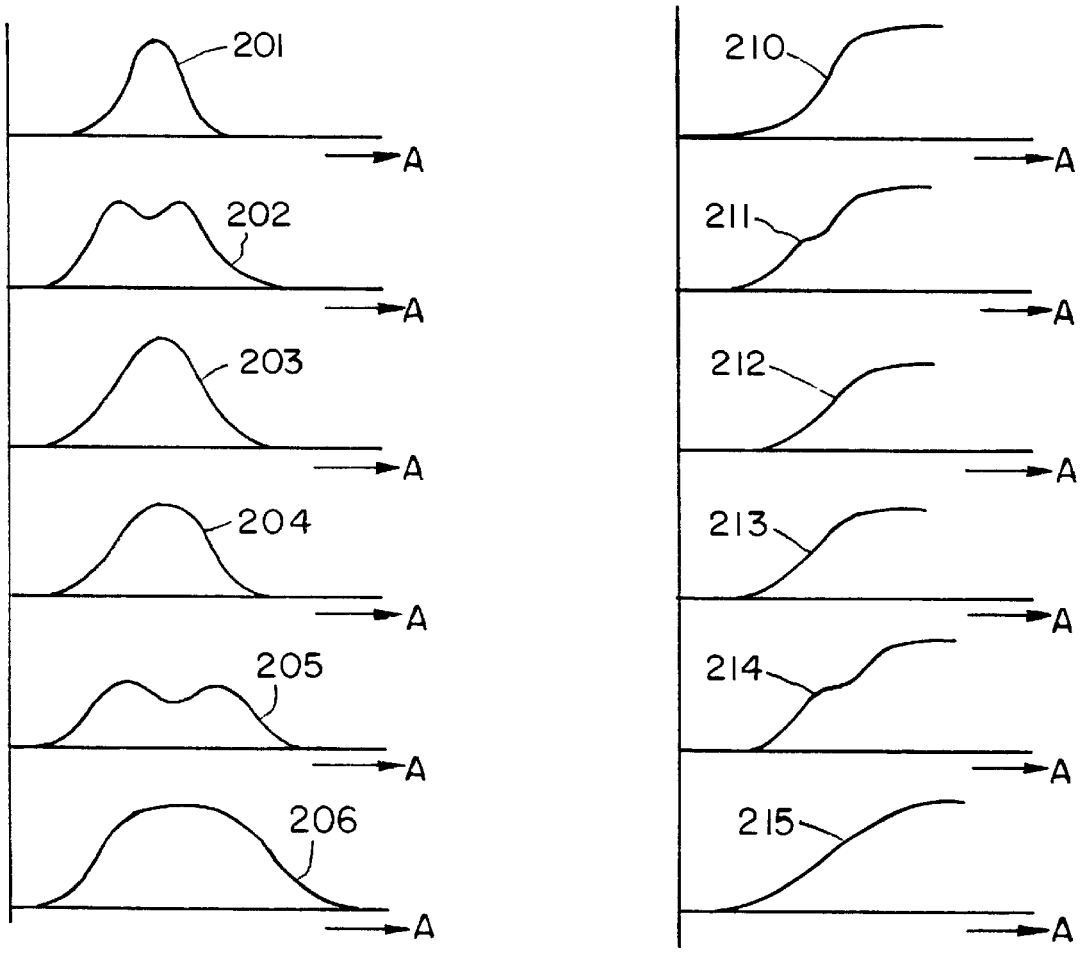
FIG. 3 illustrates a plurality of intensity curves each in correspondence with a convolved step response.

FIG. 3 shows this in detail. The impulse response due to the aperture of the eye is shown as profile 201 plotted against angular position A which is the angular position of the view with respect to the normal as shown in FIG. 1. Similarly the response of the lenticular material is shown as 202 while the response of the backcoating or a reflexion coating is shown as 203 and the response of the emulsion or image layer is shown as 204. Depending on how the image is created there may also be responses due to a printing press plate, the plate making process and the spot that exposed the plate or in a contact printing process there may also be responses due to the contact printer, the master film, or negative used in the contact printer, or the writing spot. In any event, there will also be a response due to a writing spot 205. Consequently, many components are involved in creating the image with the overall response being made up from combined individual components responses of the elements used to generate the image. This overall visual response is 206. Overall visual responses may be measured in a variety of ways. One method is by writing a single white or black frame against a black or a white background or a series of colored frames against a black or a white background and then scanning across the viewing angle A to determine the intensity of the overall visual response. However, because quite often frames switch from one scene to another, as in the case of flip images, a more accurate assessment may be to scan across a black to white edge or across colored edges to determine the individual color responses. These responses may then be differentiated to obtain the shape of the impulse response. It will be appreciated that a change in angle position along direction 125 will directly relate to a change in the position on image plane 102 where the central ray feeds the viewer's eye.

Alternatively, a more detailed analysis may be performed based on edge response in each image by convolving together the edge response data of each component and then spatially differentiating the result (dr/dx where r is the resulting function of the convolution and x is the distance across the edge) to get in the image plane 102 the final overall response which can be scaled back to the intensity as a function of the angle position of the viewer. This is done in place of convolving the view responses from individual components. Convolving step responses are shown by profiles 210, 211, 212, 213, 214, and 215 which represent the step response of the respective components corresponding to the spot responses from 201 to 206 respectively. These responses are achieved across colored edges or black to white edges.

By convolving is meant that the focus of combining two spatial functions (such as edge responses) $f_1(x)$ and $f_2(x)$ so that the result is a third convolved function $f_3(x)$. The linear continuous convolution function is defined by:

$$f_3(x)=\int f_1(x-u)f_2(u)du$$

for spot responses.

For step response data the function $f_1(x)$ is desired for $$f_1(x)=\frac{dF_1(x)}{du}$$

where $F_1(x)$ is the step response.

It may be appreciated that because scan lines run parallel to lenticules in lenticular images, the step response is actually made up of a sum of individual frame responses due to the individual scan lines which represent frames. In the case when the scanning direction is not parallel to the lenticules the effective shape of the spot representing one frame is determined by a number of factors including the manner in which the light spot is modulated, the bandwidth of the modulation amplifier, as well as the spot shape of the writing beam.

Figure 4:
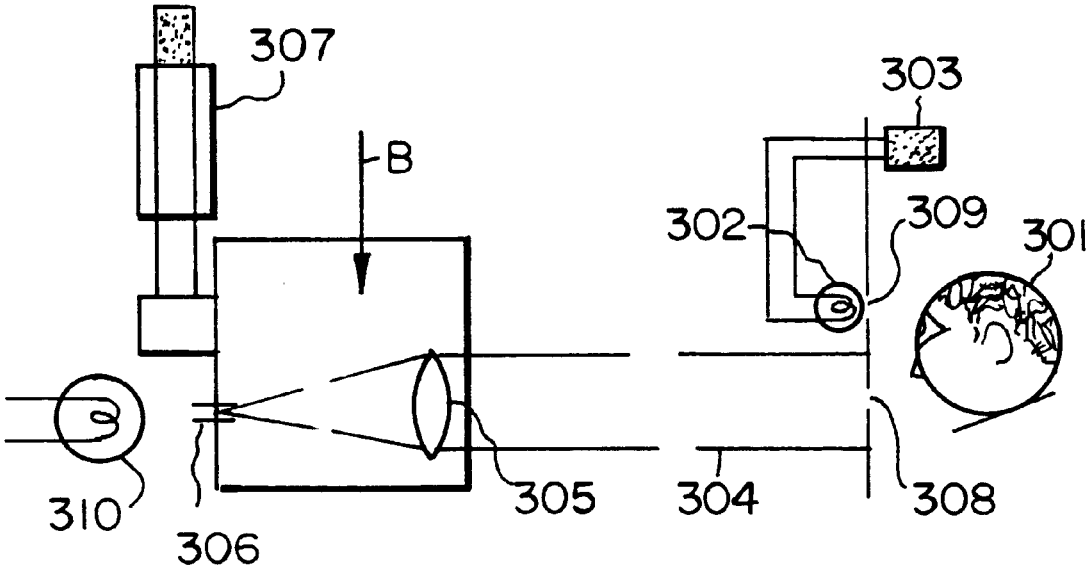
FIG. 4 illustrates testing apparatus useful in practicing the present method.

Edge response shapes or spot response shapes of the different components can be measured in different ways. For example, the edge or spot shape or impulse response of the eye can be computed from geometric considerations of the eye aperture or may be computed from physiological experimentation, for example using methods of matching slit intensities. Forming one slit, corresponding to the edge or spot profile, and another slit corresponding to an adjustable intensity slit or adjustable color slit permits a viewer to match the intensity observed from the slits. The apparatus for enabling intensity matching is shown in FIG. 4 where the viewer 301 adjusts the intensity of a light source 302 using knob 303 while a collimated beam of light 304, originating at light source 310 and passing through slit 306 to an image lens 305 to a viewing slit 308. A calibrated linear actuator 307 moves the light source 310, slit 306, and lens 305 (direction indicated by arrow B), such that the collimated beam 304 moves across the viewing slit 308. The task of the viewer 301, as the beam of light slowly moves across slit 308, is to match the intensity of light from light source 302 as seen through a slit 309, with the intensity of light from light source 310 as seen through slit 308 thereby determining the visual response to the hard edged light beam 304.

Figure 5:
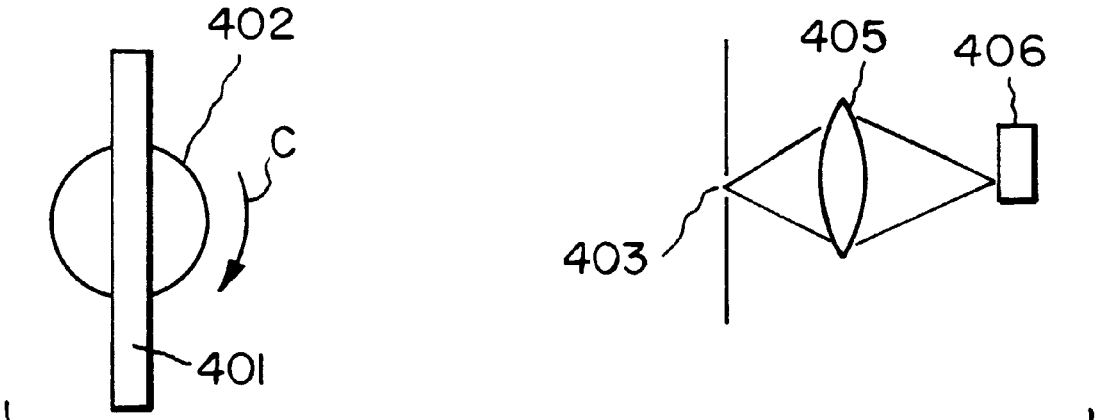
FIG. 5 illustrates an arrangement for determining intensity profiles.

To determine the shape of the overall response 206 (FIG. 3) using edge or pulse profile methods involves an arrangement shown in FIG. 5 where a goniometer construction comprising an image 401 mounted on an accurately controlled shaft 402 is caused to slowly rotate while being viewed through an imaging slit 403 which is imaged by lens 405 back to an image sensor 406. By plotting the intensity at the image sensor 406, as a function of an angle C, the overall response to either a colored or a black and white step can be determined. The angle C defines the rotational position of the shaft 402.

The spot shape of the image writing step can be determined using a commercial spot analyzer while film response is determined by writing using a known spot shape, individual frames, or a step edge and then scanning the resulting film with a microdensitometer and then deconvolving out the spot shape. Lenticular lens response can be determined by profile analysis of the lens followed by the computation of the anticipated lens response using conventional lens analysis tools. Alternatively, the lens response can be measured using a suitable lens analyzer.

Figure 6:
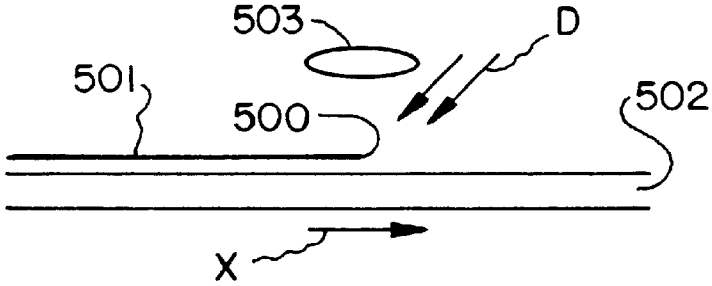
FIG. 6 is a representation useful in understanding the operation of the present method.

Back layer response can be analyzed using a microdensitometer profile analysis of an illuminated edge 500 as shown in FIG. 6 (the illumination is indicated by the arrows D) where a chrome layer 501 is brought into contact with a reflective layer 502 and light is then used to illuminate the chrome on glass edge or other sharp, well-defined edge which is constructed such that the outer surface and the inner surface of layer 501 is black and the edge is brought into the same position as the emulsion image or ink layer would be with respect to the reflective layer 502. A microdensitometer comprising microdensitometer lens 503 is then scanned across the layer to determine the edge profile response. This may then be differentiated in the sense of di/dx where i is the intensity determined through microdensitometer lens 503 and x is the direction across the edge in FIG. 6 to obtain the spot response.

Figure 7B:
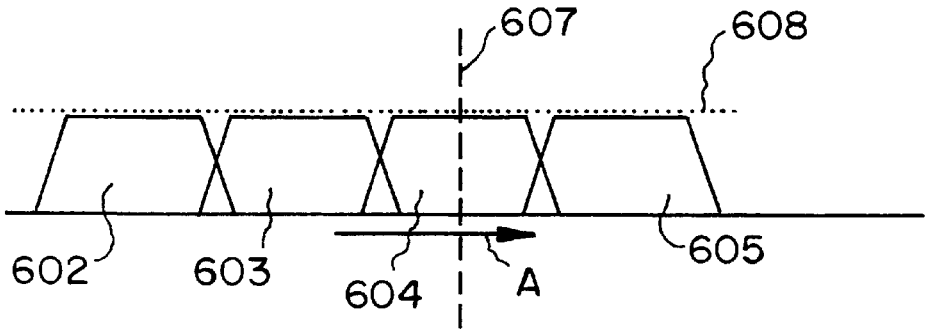
FIGS. 7A and 7B are representations of intensity profiles used with the present method.
Figure 7A:
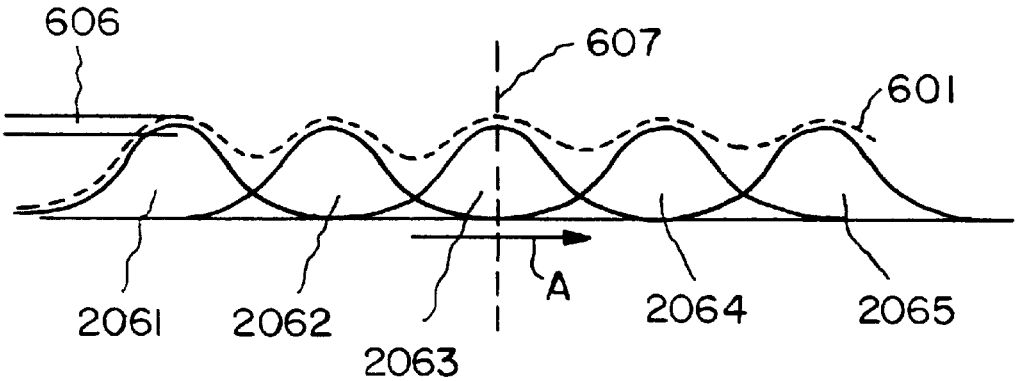

FIG. 7A shows the combined summation of overall responses 206 from consecutive frames. These overall responses are shown as 2061, 2062, 2063, 2064 and 2065. The sum of these responses is shown as 601. Referring to FIG. 7B, ideally the shape of the individual profiles would correspond to, for example, the profiles shown as 602, 603, 604 and 605, producing a sum 608 which lacks the incipient ripples of amplitude 606 (shown in FIG. 7A) because the summation produces a uniform result. The profile of the overall response is substantially trapezoidal. The image seen by a viewer viewing the intensities of FIG. 7B is considerably more pleasing than the image seen from viewing the intensities of FIG. 7A because firstly, the ripples 606 of FIG. 7A are removed in the sum 601 and also in most viewing positions corresponding to, for example, viewing position 607, shown in both FIGS. 7A and FIG. 7B, is unique, that is to say, in FIG. 7B the image seen by a viewer viewing it at angular position corresponding to line 607 sees only one view whereas the viewer viewing along line 607 in FIG. 7A sees contributions from views 2062, 2063, and 2064. And while the dominant view is 2063, views 2062 and 2064 interfere with that view.

Figure 8:
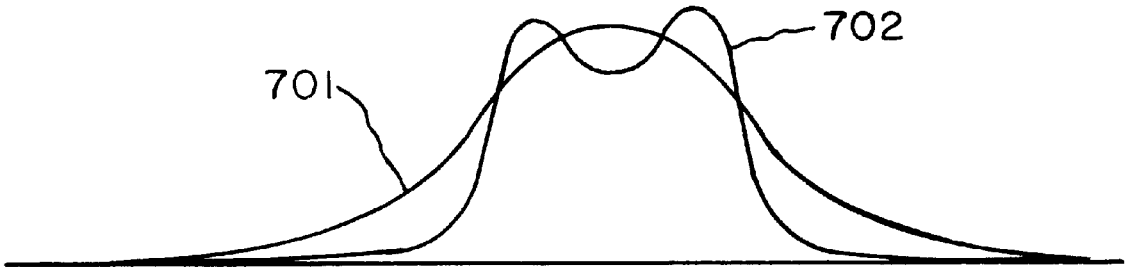
FIG. 8 represents intensity profiles.
Figure 9:
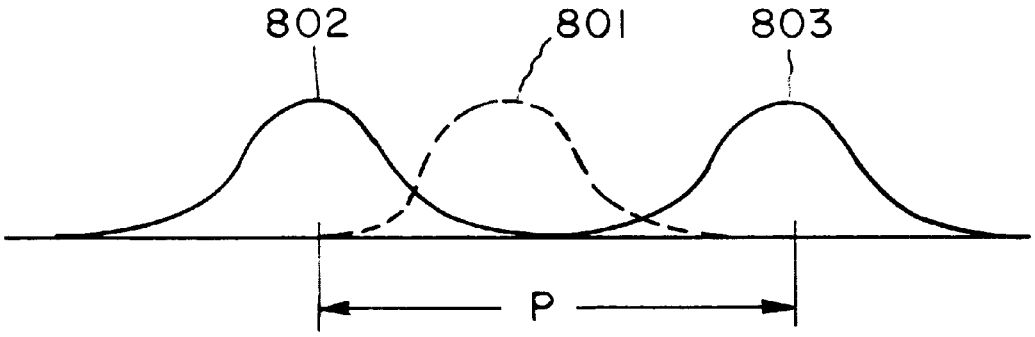
FIG. 9 represents intensity profiles as a function of lenticular pitch.

Various methods of achieving a combined profile closer to that shown in FIG. 7B such as profile 603 instead of profile 2062 are described in the following:

The first method is to modify the shape of the writing spot so that instead of having a typical shape as shown by profile 701 in FIG. 8, the writing spot would have a shape as shown by 702. This shape 702 when fed through the entire system will result in an intensity profile 206 which is closer to the profile 2062 therefore improving image quality. Another method is to take advantage of the coma or aberrations of the lenticular lens so that the lens profile appears as 702. Another alternative method is to modify the MTF of the emulsion or back layer on which the image is formed to achieve these effects. Other steps include narrowing the overall response of the entire system to that shown in FIG. 9 where the line pitch distance is p, but the spot profile has widths less than p and then writing repeated lines such as, for example, profile 801 between profiles 802 and 803 in such a way that the net response, when taken through the lenticular material and other components in the system, produces a flat response similar to the intensity response 602.

A method to achieve the desired combined spot shape is to analyze the individual step responses or edge profiles, predict the combined spot shape, confirm it experimentally using the equipment shown in FIG. 4 and then modify the shape of the writing spot, the design of the lens and the design of other elements so that the combined shape provides the optimum image separation that can be obtained without introducing ripple in the sums of responses.

Alternatively, the optimum may be found using the equipment of FIG. 5 to analyze different samples and then experimentally modify the shape of the writing spot, the design of the lens, and the design of other elements so that experimentally the combined shape provides the optimum image separation that can be obtained without introducing ripple in the sums of responses.

Still another technique for finding the optimum profile of the component performing correction function is to analyze a group of components by measuring the profiles a group of components that precede or follow the component having the adjustable shape. Then the influence of the shape adjustable component can be assessed using the convolution approach previously introduced.

A writing spot with a Gaussian profile is used to write the images on the recording material. At least one or a combination of several components of the recording material have an overall spot response shape which as a function of viewing angle has a peak on each side of a region of lower value. It is preferred that the overall spot response of at least one contributing component has a profile when subtracted from a Gaussian shaped response with the same mean value and standard deviation of the profile has a difference where there is a positive central peak of at least 10% of the area of the Gaussian shaped response and a negative peak on each side of the positive peak of at least 5% of the area of the Gaussian shaped response.

The contributing component can be the lenticular material, the back layer, which can be reflective, and the image layer. Additionally the shape of the spot response can be influenced by other factors depending on how the image is created. There may also be responses due to a printing process plate, the plate making process and the spot that exposed the plate, or in contact printing there may also be responses due to the contact printer, master film, or negative used in the contact printer.

Another aspect of this invention is to change the scan line spacing and/or the lenticular spacing based on the overall combined response of the imaging system in order to achieve the best utilization of the best overall available resolution characteristics of the system. This change is based on the fact that once the response of the system is known, the optimum lenticular pitch is a function of the content to be used (for example motion or stills) and the desired number of frames coupled with ripple of the sum or overlap of the individual images. In the absence of spot shaping and assuming an overall Gaussian shaped response the ideal lenticular pitch is given by $$n \times \sigma$$

where $\sigma$ is the standard deviation of the Gaussian shape and n lies in the range of 1.8 to 2.6.

A writing spot is scanned relative to the recording material to produce pixels directly on said recording material. The line pitch between successive scan lines is defined by the lenticular spacing. In order to write an additional line between two lines separated by the line pitch p (see FIG. 9) the width of the writing spot has to be less than the line pitch p. As a result of the above writing the overall response will be substantially trapezoidal.

Yet another aspect of this invention is to choose the overall characteristics of the system including scan line spacing and lenticular spacing as well as overall spot shape as a function of the content and characteristics of the image to be written. For an image collage comprising content from or combinations of still images which can be used to make a lenticular image, closely spaced lenticules are preferred as this gives better detail in the images whereas for motion images more widely spaced lenticules give better quality as they provide more motion frames for a given overall combined spot response.

There are various means for modifying the shape of the profile of the components which have been selected to modify the overall combined response. Because, it is generally necessary to achieve a profile with two peaks or one which compensates for the effects of the intrinsic Gaussian shape of other components, it is necessary to have a means to change both shape and intensity of the profile.

For example, for the writing spot focus, lens design modification, the use of multiple beams, semi-transparent stops, and other means can be employed.

The impulse response of a thermal head can be changed by modifying the shape of the resistive elements that write the (heat) head.

The MTF response, and therefore the spot and edge response of media, can be modified in numerous ways. For example, in the case of photographic emulsions, there are a variety of design parameters including grain size, emulsion composition, order of layers, chemical edge enhancement effects, anti-halation, interlayer couplers, and design changes which modify chemical diffusion affects. The photofinishing process can also change the MTF by changing photofinishing parameters and chemistry.

In the case of thermal media, MTF can also be changed. This is done by changing layer thickness and choosing dye sublimation temperature as well as the dye migration rates as a function of temperature.

The response of lenticular lenses can be modified in numerous ways, for example, by changing the shape and focusing distance of the lens with respect to the media. The use of aspheric lenses and choosing materials with different refractive indices. Spherical aberration may also be used to create the desired overall visual response shape (see FIG. 7B).

The invention has been described with reference to a preferred embodiment; However, it will be appreciated that variations and modifications can be effected by a person of ordinary skill in the art without departing from the scope of the invention.

Parts List

| | |
|---|---|
| 100 | lenticular lens sheet |
| 101 | lenticular lens |
| 102 | image plane |
| 103 | view |
| 104 | view |
| 105 | view |
| 110 | viewing direction |
| 111 | viewing direction |
| 120 | viewer's eye |
| 125 | direction |
| 150 | movie camera |
| 151 | moving scene |
| 152 | computer |
| 153 | writer |
| 154 | line |
| 155 | printer |
| 154 | negative image |
| 157 | light source |
| 158 | exposed print |
| 201 | profile impulse response due to aperture of eye |
| 202 | response of lenticular material |
| 203 | response of backcoating |
| 204 | response of emulsion or image layer |
| 205 | response due to a writing spot |
| 206 | overall response |
| 210 | convolving step response corresponding to 201 |
| 211 | convolving step response corresponding to 202 |
| 212 | convolving step response corresponding to 203 |
| 213 | convolving step response corresponding to 204 |
| 214 | convolving step response corresponding to 205 |
| 215 | convolving step response corresponding to 206 |
| 301 | viewer |
| 302 | light source |
| 303 | knob |
| 304 | beam of light |
| 305 | image lens |
| 306 | illuminated slit |
| 307 | calibrated linear actuator |
| 308 | slit |
| 310 | light source |
| 309 | slit |
| 401 | image |
| 402 | shaft |
| 403 | imaging slit |
| 405 | lens |

-continued

| | |
|---|---|
| 406 | image sensor |
| 501 | chrome layer |
| 502 | reflective layer |
| 503 | microdensitometer lens |
| 601 | sum of overall responses |
| 602 | profile |
| 603 | profile |
| 604 | profile |
| 605 | profile |
| 606 | ripples of amplitude |
| 607 | viewing position |
| 608 | sum of profiles |
| 701 | profile |
| 702 | writing spot shape |
| 801 | profile |
| 802 | profile |
| 803 | profile |
| 2061 | overall response |
| 2062 | overall response |
| 2063 | overall response |
| 2064 | overall response |
| 2065 | overall response |
| A | viewing angle |
| B | moving direction |
| C | rotational position of shaft |
| X | distance across an edge |

What is claimed is:

1. A method for producing lenticular images having an effective spot shape seen by the viewer that is a combined effect of a series of contributing components and an overall combined response that is a summation of the effective spot shapes, comprising the steps of:

a) determining the effective spot shape seen by a viewer in a lenticular image; and b) modifying one or more contributing components so that the effective spot shape is substantially trapezoidal and the overall combined response is uniform.

2. The method claimed in claim 1, wherein the contributing component is writing spot, and wherein the shape of the writing spot as a function of viewing angle has a peak on each side of a region of lower value.

3. The method claimed in claim, 2, wherein the writing spot has a profile, a mean value and a standard deviation such that when subtracted from a Gaussian shape with the same mean value and standard deviation, the difference has a positive central peak of at least 10% of the area of the Gaussian shape and a negative peak on each side of the positive peak of at least 5% of the area of the Gaussian shape.

4. The method claimed in claim 1, wherein the contributing component is a lenticular lens and a profile of the lens response as a function of viewing angle has a peak on each side of a region of lower value.

5. The method claimed in claim 1, wherein the contributing component is a photographic emulsion having a modulation transfer function that produces a response profile that has a peak on each side of a region of lower value.

* * * * *